US006823811B1

(12) United States Patent
Drake

(10) Patent No.: US 6,823,811 B1
(45) Date of Patent: Nov. 30, 2004

(54) BUOY BOARD

(76) Inventor: Michael L. Drake, 32 Weather Oak Hill, New Windsor, NY (US) 12553

( * ) Notice: Subject to any disclaimer, the term of this patent is extended or adjusted under 35 U.S.C. 154(b) by 0 days.

(21) Appl. No.: 10/737,939

(22) Filed: Dec. 18, 2003

(51) Int. Cl.[7] ..... B63B 59/02
(52) U.S. Cl. ..... 114/219; 405/212
(58) Field of Search ..... 114/219; 405/211, 405/212, 215; 248/218.4, 219.1, 219.4

(56) References Cited

U.S. PATENT DOCUMENTS

| | | | | | |
|---|---|---|---|---|---|
| 2,244,887 | A | | 6/1941 | Manley | |
| 2,513,474 | A | | 7/1950 | Greer | |
| 3,239,183 | A | | 3/1966 | Price et al. | |
| 3,240,863 | A | | 3/1966 | Brede | |
| 3,449,917 | A | * | 6/1969 | Roskopf | 405/215 |
| 3,975,916 | A | * | 8/1976 | Watson | 405/212 |
| 4,325,529 | A | * | 4/1982 | Seebinger | 248/218.4 |
| 4,773,349 | A | * | 9/1988 | McKinney | 114/219 |
| 5,014,955 | A | | 5/1991 | Thompson | |
| 5,018,471 | A | * | 5/1991 | Stevens | 405/211 |
| 5,673,889 | A | | 10/1997 | DeValcourt | |
| 5,702,081 | A | | 12/1997 | Gallemore, II | |
| 6,244,920 | B1 | | 6/2001 | de Baan | |
| 6,327,989 | B1 | * | 12/2001 | Beach | 114/219 |
| 6,390,009 | B2 | | 5/2002 | Brown et al. | |
| 6,439,149 | B1 | | 8/2002 | Hile | |
| 6,508,446 | B1 | | 1/2003 | Addison et al. | |
| 6,532,885 | B1 | | 3/2003 | Cordoba | |
| 6,581,891 | B1 | | 6/2003 | Byrd | |
| 2002/0113182 | A1 | | 8/2002 | Boghosian | |

* cited by examiner

*Primary Examiner*—Lars A. Olson
(74) *Attorney, Agent, or Firm*—Joseph L. Spiegel

(57) ABSTRACT

An article or buoy board for mooring a buoy to a dock post when a boat is being moored at a dock that includes an elongated board with slotted end portions and having a front surface and a back surface. Straps are affixed to the front surface of the board for positioning the back surface of the board against the dock post. A stretchable cord such as a bungee cord passes through the slotted end portions of the board for attaching a buoy to the front surface of the board for contact with the boat side. The back surface of the board is provided with a lengthwise groove for receiving the stretchable cord and the back surface of the board is further provided with a shock-absorbing pad such as rubber for holding the stretchable cord in place within the groove and for minimizing shock as the boat is moored. The stretchable cord has ends with hooks and the buoy has ends with eyes so that the buoy is attached against the board by passing the cord hooks through the buoy eyes. The front surface of the board is grooved crosswise for receiving the straps such the straps are flush with the front surface with the front surface of the board.

7 Claims, 4 Drawing Sheets

BUOY BOARD

BACKGROUND OF THE INVENTION

1. Field of the Invention

This invention relates to an article useful in protecting the sides of a boat, when a boat is being moored at a dock, and in particular to an article for mooring a buoy to a dock post.

2. Description of the Prior Art

When mooring a boat at a dock it is important to protect the sides of the boat from damage caused by impact with the dock itself.

In the past it has been common practice to strap a buoy, by means of a bungee cord to a dock post, positioning it between the post and the boat side. The problem has been that when the boat hits the buoy, it moves or slides the buoy to the side or down too far so that the boat no longer hits the buoy at all with the result that damage can occur.

SUMMARY OF THE INVENTION

Accordingly, an object of the invention is an article useful when mooring a boat at a dock.

Another object is such an article that is simple to use and can easily be installed from the boat.

These and other objects, features and advantages are accomplished in accordance with the teachings of the present invention, one illustrative embodiment of which comprises an article or buoy board for mooring a buoy to a dock post when a boat is being moored at a dock that includes an elongated board with slotted end portions and having a front surface and a back surface. Straps are affixed to the front surface of the board for positioning the back surface of the board against the dock post. A stretchable cord such as a bungee cord passes through the slotted end portions of the board for attaching a buoy to the front surface of the board for contact with the boat side. The back surface of the board is provided with a lengthwise groove for receiving the stretchable cord and the back surface of the board is further provided with a shock-absorbing pad such as rubber for holding the stretchable cord in place within the groove and for minimizing shock as the boat is moored. The stretchable cord has ends with hooks and the buoy has ends with eyes so that the buoy is attached against the board by passing the cord hooks through the buoy eyes. The front surface of the board is grooved crosswise for receiving the straps such the straps are flush with the front surface with the front surface of the board.

BRIEF DESCRIPTION OF THE DRAWING

Other objects, features and advantages of the present invention will be apparent from the following detailed description and accompany drawing, wherein.

DETAILED DESCRIPTION

Figure 1:
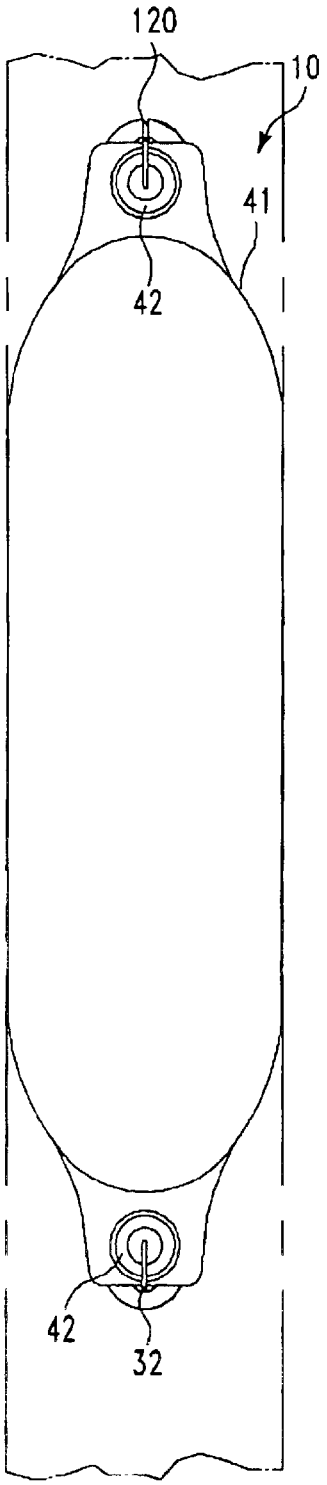
FIG. 1 is a front view of the buoy board of the present invention, with buoy in place.
Figure 2:
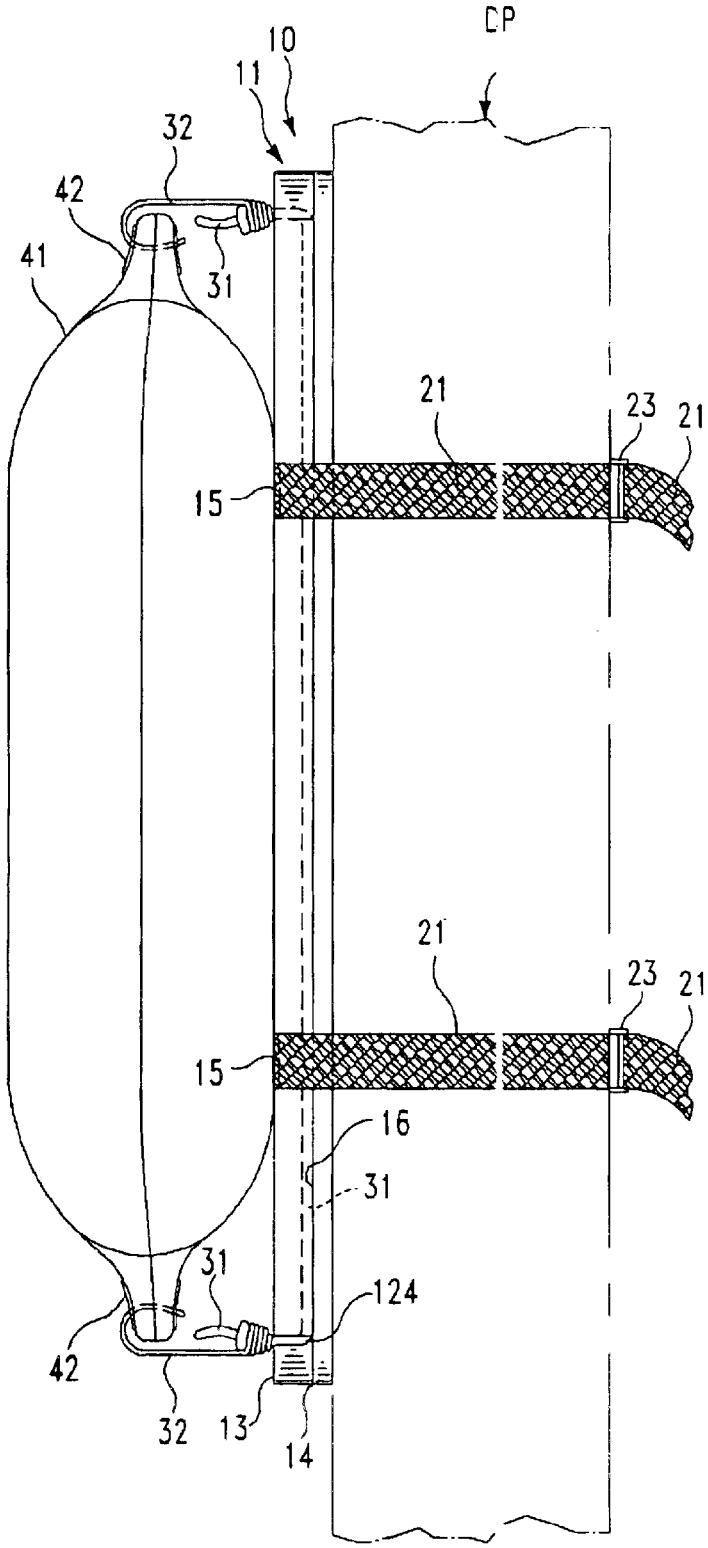
FIG. 2 is a side view of the buoy board shown strapped to a dock post.
Figure 3:
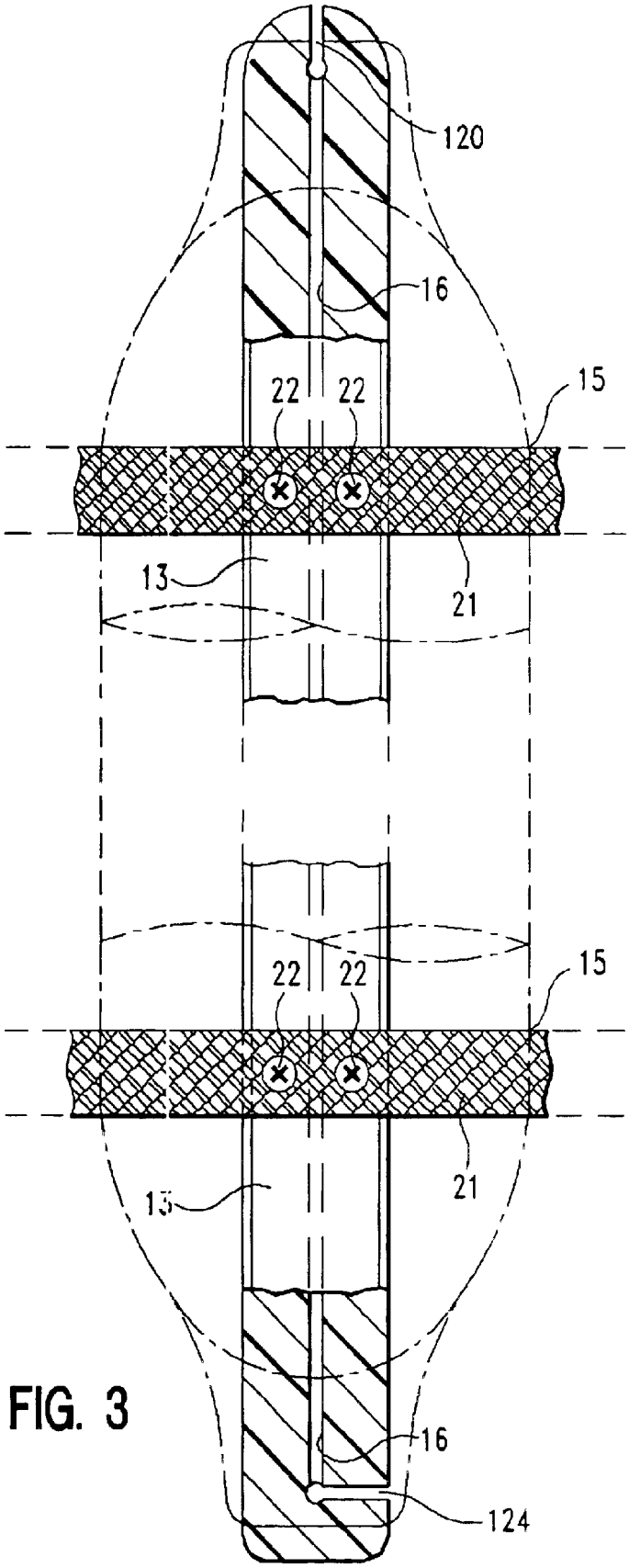
FIG. 3 is a front view, partially broken away, showing the stretchable cord slots and groove in the buoy board and the manner of affixing the strap to the board.

Referring now to FIGS. 1, 2 and 3 of the drawing, an article for mooring a buoy to a dock post is shown at 10. The article is seen as including an elongated board 11 with slotted end portions 120 and 124 and having a front surface 13 and a back surface 14. Straps 21 are affixed to the front surface 13 of the board 11 for positioning the back surface 14 of the board 11 against a dock post DP. A stretchable cord 31 passing through the slotted end portions 120 and 124 is used for positioning a buoy 41 against the front surface 13 of the board 11 for contact with a boat side (not shown).

Board 11 is typically 24 inches long, 2.5 inches wide and 1 inch thick, It can be made of wood such as oak, maple or teak, wood-board, plexiglas or plastic. The slots 120 and 124 are formed by first drilling a hole in the board and slotting to the hole, vertically in the case of 120 and in the case of 124 either vertically or, as shown in the drawing, horizontally. The slotting width is narrower than the diameter of the drilled hole. When a cord is inserted in a slot it is first stretched to slide through the slot until it reaches where the hole has been drilled. The narrower width of the slots serves to hold a cord in place in the drilled hole. Where the slot 124 in the lower part of the board 11 is horizontal, it will also serve to prevent the cord 31 from falling out of the board 11.

Referring to FIGS. 2 and 3 of the drawing, the front surface 13 of board 11 is grooved at 15 crosswise for receiving the straps 21 such that the straps will be flush with the front surface 13 so as to avoid fraying of the strap. Typically, the grooves 15 are the depth and width of the strap.

The back surface 14 is provided with a lengthwise groove 16 (FIGS. 2 and 4) for receiving the stretchable cord 31. Groove 16 is typically ⅜ inch thick and ¼ inch deep. A shock-absorbing pad 51 that essentially covers the back surface 14 is glued to the back surface 14 on one side of the groove 16. When the cord 31 is positioned beneath the pad 51, the pad serves to hold cord 31 in place within groove 16, and also minimizes shock as the boat is moored. It also prevents the board 11 from shifting on the dock post DP. Typically, pad 51 is rubber, ⅜ inch thick.

Figure 4:
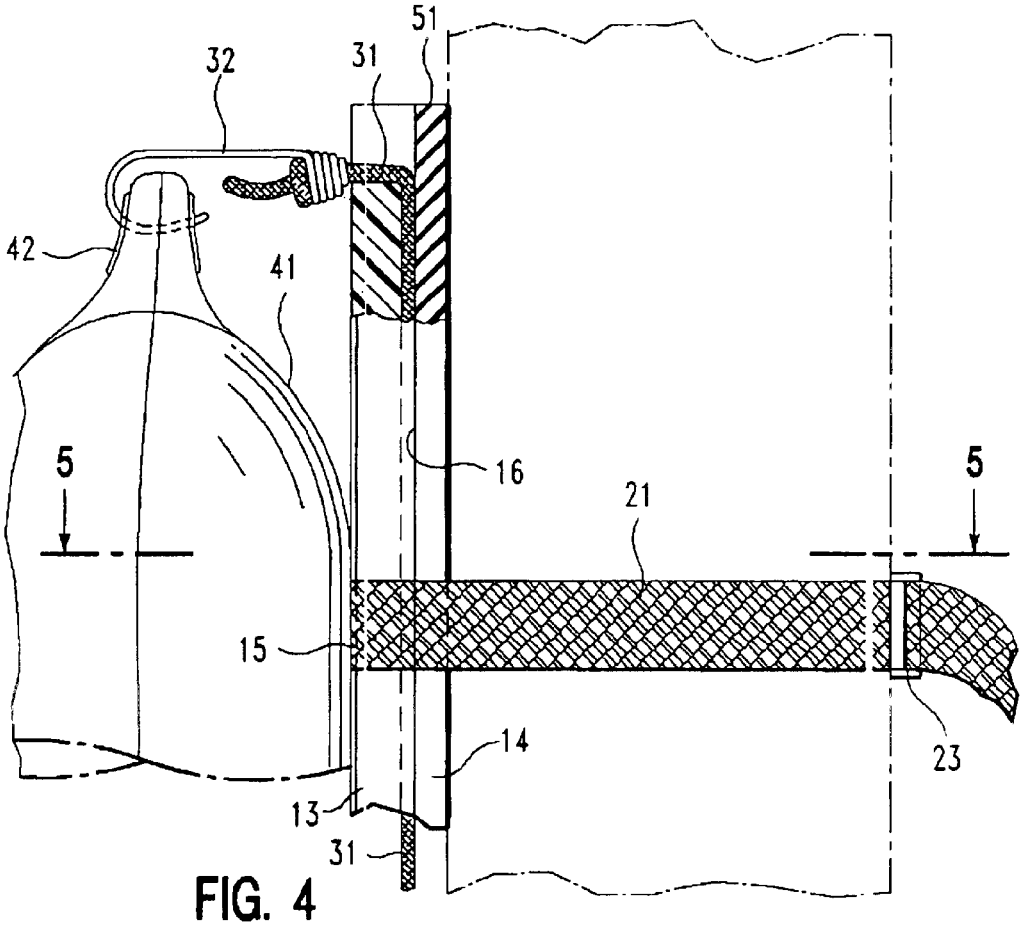
FIG. 4 is a fragmentary side view, partially broken away showing portions of the stretchable cord, pad and strap for the buoy board.

Referring again to FIG. 3, straps 21 are affixed to front surface 13 by a ¾ inch screw with washer arrangement designated generally at 22. Alternatively, the straps could be riveted. The ends of the straps 21 are provided with a buckle arrangement 23 (FIGS. 2 and 4).

Referring again to FIGS. 2 and 4, the stretchable cord 31, which typically is a bungee cord, is provided with hooks 32 at its ends. A buoy 41 is positioned against the front surface 13 of the board 11 by passing the hooks 32 through the eyes 42 of the buoy 41. For a 24 inch board the cord will be 12–18 inches. Board length will vary depending on buoy length as will the length of the cord.

Figure 5:
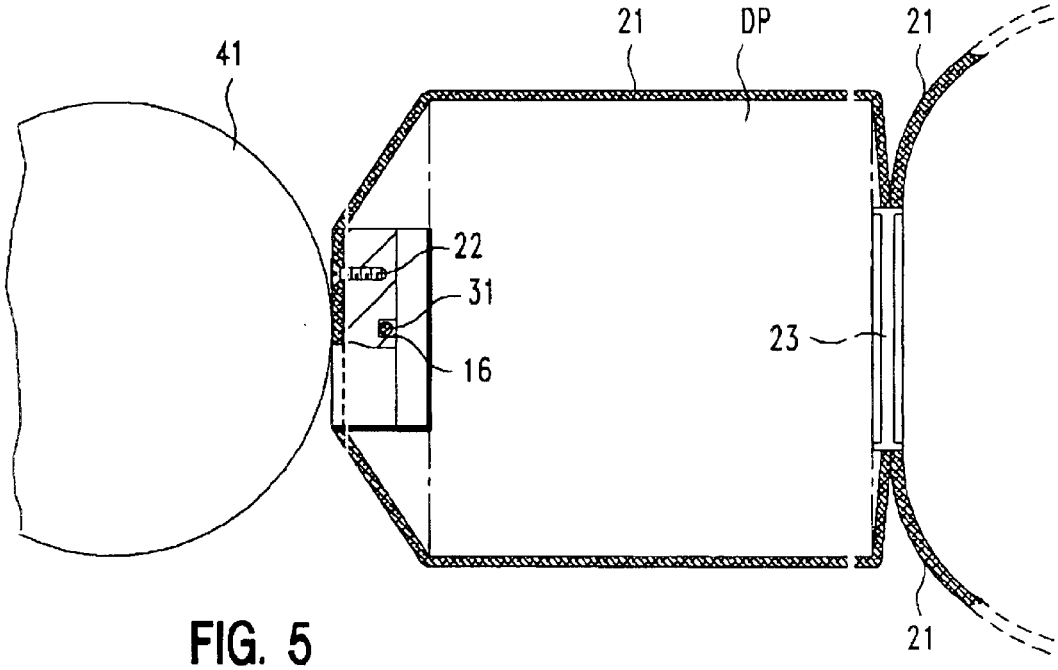
FIG. 5 is a top view, taken along the line 5—5 in FIG. 4, of the board as strapped to a dock post; and, FIG. 6 is an alternate embodiment of the present invention where the board is curved.

The article 10 is carried on-board with a buoy 41 secured to the board 11. When the boat is close enough to the dock, the board 11 is strapped to the dock post DP (FIG. 5) with the buoy 41 facing outwardly towards the boat. In the past, where a buoy is strapped to the dock itself, when the boat hits the buoy it slides the buoy around to the side or down too far and then it doesn't contact the buoy at all. With the present invention, when the boat hits the buoy and the buoy shifts, the stretchable cord will bring the buoy right back to the original position. The buoy board 10 is portable so that when one leaves the dock the buoy board 10 is unstrapped and taken on-board for re-use.

Figure 6:
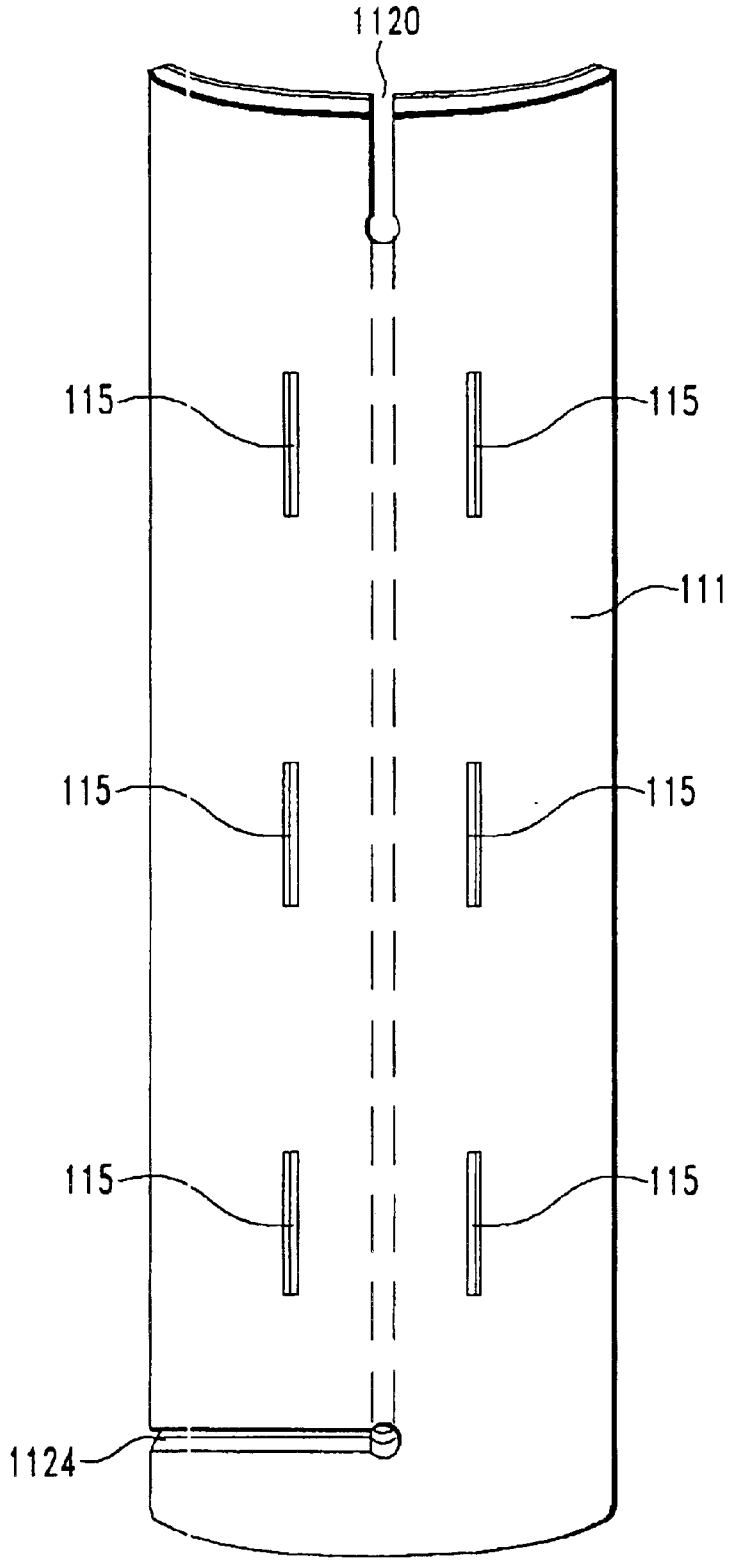

FIG. 6 depicts an alternate embodiment of the present invention in which the board 111 is curved for when a dock post is round. The board includes the upper 1120 and lower 1124 slots, vertical slots 115 for receipt of straps (not shown) and lengthwise groove 116 for receipt of a cord (not shown).

It should be obvious that changes, additions and omissions may be made in the details and arrangement of parts without departing from the spirit and scope of the invention as hereinafter claimed.

What is claimed is:

1. An article for mooring a buoy to a dock post when a boat is being moored at a dock, comprising:

an elongated board with slotted end portions and having a front surface and a back surface;

straps affixed to the front surface of the board for positioning the back surface of the board against the dock post; and, a stretchable cord passing through the slotted end portions of the board for positioning a buoy against the front surface of the board for contact with the boat side.

2. The article of claim 1 wherein the back surface of the board is provided with a lengthwise groove for receiving the stretchable cord and the back surface of the board is further provided with a shock-absorbing pad for holding the stretchable cord in place within the groove and for minimizing shock as the boat is moored.

3. The article of claim 2 wherein the shock absorbing pad is rubber.

4. The article of claim 2 wherein the stretchable cord has ends with hooks and the article includes a buoy having ends with eyes and the buoy is attached against the board by passing cord hooks through buoy eyes.

5. The article of claim 2 wherein the stretchable cord is a bungee cord.

6. The article of claim 1 wherein the front surface of the board is grooved crosswise for receiving the straps such that the straps are flush with the front surface.

7. The article of claim 1 wherein the board is curved.

* * * * *